US006406548B1

(12) United States Patent
Donovan et al.

(10) Patent No.: US 6,406,548 B1
(45) Date of Patent: Jun. 18, 2002

(54) SUGAR CANE MEMBRANE FILTRATION PROCESS

(75) Inventors: Michael Donovan, Great Dunmow (GB); Robert P. Jansen, Chevychase, MD (US); Richard C. Reisig, Scottsbluf, NE (US); Marc Hlavacek, London (GB); Gordon Walker, Reading (GB); John C. Williams, Wokingham (GB)

(73) Assignees: Tate & Lyle Industries, Limited, London (GB); Tate & Lyle, Inc., Decatur, IL (US)

( * ) Notice: Subject to any disclaimer, the term of this patent is extended or adjusted under 35 U.S.C. 154(b) by 0 days.

(21) Appl. No.: 09/618,830

(22) Filed: Jul. 18, 2000

(51) Int. Cl.[7] ..... C13D 3/16; C13D 1/02

(52) U.S. Cl. ..... 127/55; 127/43; 127/46.2; 127/48; 127/52; 127/54

(58) Field of Search ..... 127/43, 46.2, 48, 127/52, 53, 54, 55

(56) References Cited

U.S. PATENT DOCUMENTS

| | | | |
|---|---|---|---|
| 1,578,463 A | 3/1926 | Nicholson et al. | |
| 1,815,276 A | 7/1931 | Schwieger | |
| 2,164,186 A | 6/1939 | Brown et al. | 127/50 |
| 2,557,800 A | 6/1951 | Seailles | 127/52 |
| 2,697,049 A | 12/1954 | Brieghel-Müller | 127/50 |
| 2,801,940 A | 8/1957 | Stark et al. | 127/44 |
| 2,824,028 A | 2/1958 | Zenzes | 127/50 |
| 2,977,253 A | 3/1961 | Grandadam | 127/50 |
| 3,113,044 A | 12/1963 | Alston | 127/48 |
| 3,168,419 A | 2/1965 | Gale | 127/50 |
| 3,926,662 A | 12/1975 | Rundell et al. | 127/48 |
| 4,115,147 A | 9/1978 | Shimizu et al. | 127/54 |

(List continued on next page.)

FOREIGN PATENT DOCUMENTS

| | | |
|---|---|---|
| CZ | 107886 | 7/1963 |
| DE | 813139 | 9/1951 |
| DE | 942552 | 5/1956 |

(List continued on next page.)

OTHER PUBLICATIONS

Nielsen et al., "Prospects and Possibilities in Application of Membrane Filtration Systems Within the Beet and Cane Sugar Industry," *Sugar Technology Reviews* 9:59–117 (1982), no month provided.

(List continued on next page.)

*Primary Examiner*—David Brunsman
(74) *Attorney, Agent, or Firm*—Williams, Morgan & Amerson, P.C.

(57) ABSTRACT

A process for producing sugar from cane includes the step of filtering a sucrose-containing feed juice, which has been obtained from macerated sugar cane, through a first ultrafiltration membrane that has a first molecular weight cutoff. This ultrafiltration step produces a first ultrafiltration permeate and a first ultrafiltration retentate. The first ultrafiltration permeate is filtered through a second ultrafiltration membrane that has a second molecular weight cutoff that is lower than the first molecular weight cutoff. This second ultrafiltration step produces a second ultrafiltration permeate and a second ultrafiltration retentate. The second ultrafiltration permeate is nanofiltered through a nanofiltration membrane, thereby producing a nanofiltration permeate and a nanofiltration retentate. The nanofiltration retentate has a higher concentration of sucrose on a dry solids basis than the feed juice in step (a), and can be used in evaporation and crystallization operations to produce crystals of white sugar. The process can optionally include ion exchange and/or electrodialysis purification steps, prior to or after the nanofiltration step. Recycle syrups can be treated with a chromatographic separator to remove excess invert, ash and color.

83 Claims, 2 Drawing Sheets

U.S. PATENT DOCUMENTS

| | | | | |
|---|---|---|---|---|
| 4,328,043 | A | 5/1982 | Freytag et al. | 127/44 |
| 4,332,622 | A | 6/1982 | Hohnerlein, Jr. | 127/41 |
| 4,432,806 | A | 2/1984 | Madsen et al. | 127/48 |
| 4,478,645 | A | 10/1984 | Gudnason | 127/57 |
| 4,702,839 | A | 10/1987 | Koerts et al. | 210/638 |
| 4,716,044 | A | 12/1987 | Thomas et al. | 426/51 |
| 4,795,494 | A | 1/1989 | Toth et al. | 127/48 |
| 5,145,584 | A | 9/1992 | Swamikannu | 210/650 |
| 5,254,174 | A | 10/1993 | Hansen et al. | 127/53 |
| 5,281,279 | A | 1/1994 | Gil et al. | 127/46.1 |
| 5,320,681 | A | 6/1994 | Moe et al. | 127/46.1 |
| 5,403,604 | A | 4/1995 | Black, Jr. et al. | 426/330.5 |
| 5,454,952 | A | 10/1995 | Brewer | 210/651 |
| 5,466,294 | A | 11/1995 | Kearney et al. | 127/42 |
| 5,468,300 | A | 11/1995 | Monclin | 127/43 |
| 5,468,301 | A | 11/1995 | Monclin | 127/43 |
| 5,480,490 | A | 1/1996 | Toth et al. | 127/42 |
| 5,554,227 | A | 9/1996 | Kwok et al. | 127/58 |
| 5,685,990 | A | 11/1997 | Saugmann et al. | 210/650 |
| 5,747,089 | A | 5/1998 | Ljusberg et al. | 426/478 |
| 5,759,283 | A | 6/1998 | Ekern et al. | 127/42 |
| 5,902,408 | A | 5/1999 | Player et al. | 27/30 |
| 5,902,409 | A | 5/1999 | Kwok et al. | 127/58 |

FOREIGN PATENT DOCUMENTS

| | | | | |
|---|---|---|---|---|
| GB | 1361674 | * | 7/1974 | C13D/3/16 |
| WO | WO92/08810 | | 5/1992 | |
| WO | WO92/10948 | | 7/1992 | |
| WO | WO93/07766 | | 4/1993 | |
| WO | WO98/24331 | | 6/1998 | |
| DE | 1 003 150 | | 8/1957 | |
| EP | 0957178 A2 | | 11/1999 | |

OTHER PUBLICATIONS

Kishihara et al., "Improvement of Flux in Ultrafiltration of Cane Juice," *Int. Sugar Jnl.* 85:99–102 (1983), no month provided.

Hanssens et al., "Ultrafiltration as an Alternative for Raw Juice Purification in the Beet Sugar Industry" (17$^{th}$ General Assembly of C.I.T.S., Copenhagen 1983), no month provided.

"Membrane Filtration," *Food Engineering* (Nov. 1987).

"Purification Using Membrane Filtration," *Sugar Journal* (Nov. 1994).

Abram et al., "Sugar Refining: Present Technology and Future Developments," *Sugar: Science and Technology*, Chapter 3, pp. 49–95 (1979), no month provided.

Kort, "Colour in the Sugar Industry," *Sugar: Science and Technology*, Chapter 4, pp. 97–130 (1979), no month provided.

Reinefeld, "Progress in the Technology of Beet–Sugar," *Sugar: Science and Technology*, Chapter 5, pp. 131–149 (1979), no month provided.

Chen, "Outline of Process for Manufacturing Raw Cane Sugar," *Cane Sugar Handbook*, Chapter 2, pp. 47–105, 127–186 and 526–559 (1985), no month provided.

Lancrenon et al., "Mineral Mebranes for the Sugar Industry," *Sugar y Azucar*, pp. 40–45 (1993), no month provided.

Hartmann, "Lime and Carbon Dioxide Production," *Beet–Sugar Technology*, Chapter XVII, pp. 567–593 (1982), no month provided.

Toth, "The Wescot Juice Purification System" (1989 ASSBT Meeting, New Orleans, Louisiana, Feb. 26–Mar. 2, 1989).

"Beet Sugar Process," Western Sugar, no date provided.

Derwent Abstract, DD 136455 (1979), no month provided.

Derwent Abstract, DE 3229345 (1984), no month provided.

Derwent Abstract, EP 635578 (1995), no month provided.

Derwent Abstract, EP 655507 (1995), no month provided.

Derwent Abstract, RU 2016637 (1994), no month provided.

Derwent Abstract, JP 5004929 (1993), no month provided.

Derwent Abstract, JP 6287199 (1994), no month provided.

Derwent Abstract, SU 1669984 (1991), no month provided.

Derwent Abstract, NL 8800175 (1989), no month provided.

Derwent Abstract, FR 2586360 (1987), no month provided.

Derwent Abstract, US 4999116 (1991), no month provided.

Derwent Abstract, RU 2016637 (1994), no month provided.

Derwent Abstract, JP 5004929 (1993), no month provided.

Derwent Abstract, DE 3229345 (1984), no month provided.

Derwent Abstract, US 5008254 (1991), no month provided.

Derwent Abstract, JP 6287199 (1994), no month provided.

Derwent Abstract, SU 1756817 (1992), no month provided.

Derwent Abstract, SU 1669984 (1991), no month provided.

Derwent Abstract, WO 9208810 (1992), no month provided.

Derwent Abstract, NL 8800175 (1989), no month provided.

Derwent Abstract, FR 2586360 (1987), no month provided.

Derwent Abstract, DE 3229345 (1984), no month provided.

Derwent Abstract, DD 136455 (1979), no month provided.

Freeman, "New Processes for Recovering Sugar from Sugar Beets," *Sugar* 48:161–162 (1953), no month provided.

Dorfeldt, "Manufacture of Sugar from Rasped Beets," *Zeitschrift Zuckerindustrie* 2:379–383 (1952), no month provided.

Brownell et al., "Explosion Process for Recovering Sugar from Sugar Beets," *Sugar*, p. 66 (1952), no month provided.

Cheryan, "Membrane Separation Processes and Their Use in Purifying or Concentrating Liquid Food Systems," *Activity Report, Research and Development Associates for Military Food and Packaging Systems* 44:164–181 (1992), no month provided.

Urano et al., "Separation Properties for Oligosaccharides of Nanofiltration Membranes and Its Application to a Purification Process of Jerusalem Artichoke Oligosaccharides," *Nippon Shokuhin Kagaku Kogaku Kaishi* 44:457–462 (1997), no month provided.

Madsen, "New Developments in the Purification of Beet Sugar," *Int. Sugar Jnl.* 92:221–223 (1990), no month provided.

Saska et al., "Direct Production of White Cane Sugar with Clarification and Decolorization Membranes—Part I," *Sugar Journal* 58:19–21 (1995), no month provided.

Saska et al., "Direct Production of White Cane Sugar with Clarification and Decolorization Membranes—Part II," *Sugar Journal* 58:29–31 (1995), no month provided.

Saska et al., "Concentration and Decolorization of Dilute Products from Cane Molasses Desugarization with Reverse Osmosis and Nanofiltration Membranes," 1994 Sugar Industry Technologists Meeting, Honolulu, Hawaii (May 8–11, 1994).

Cartier et al., "Dévelopment Actuel et Potentiel Des Procédés Á Membranes en Sucrerie et Raffinerie De Canne," *Ind. Alim. Agr. Juillet/Août,* pp. 557–560 (1996), no month provided.

Spengler et al., "Experiments on Raw Juice Extraction, Using a Continuously Operating Diffusor from Harburger Oelwerke Brinckman & Mergell," *Ztschr. Wirtschaftsgruppe Zuckerind* 91:275–333 (1941), no month provided.
Müller, "Extraction of Raw Juice According to the Steckel Process," *Zeitschrift fur die Zuckerindustrie*, pp. 207–209 (1961), no month provided.
"Desugarization of Sugar Beet Mash", no date provided.
Dörfeldt, "Raw Juice Extract from Beet Pulp," *Zuckerindustrie: Fachorgan für Technik, Rübenbau und Wirtschaft* 2:379–383 (1952), no month provided.
Schneider, "Beet Comminution," *Technologie des Zuckers*, pp. 135–136, 171 (excepts) (1968), no month provided.

* cited by examiner

SUGAR CANE MEMBRANE FILTRATION PROCESS

BACKGROUND OF THE INVENTION

The present invention relates to a process for obtaining sucrose from sugar cane.

The production of cane sugar for human consumption generally comprises two distinct operations, namely the production of raw sugar and the production of refined sugar. Production of raw sugar typically takes place at a sugar mill. In the mill, sugar cane stalks are chopped into pieces and the pieces are crushed in a series of mills in order to extract the juice. The juice from the first set of roller mills is referred to as "first juice," while the total juice from all the roller mills in the process is referred to as "mixed juice." The juice is normally limed, deaerated and clarified (i.e., removal of suspended solids, usually by sedimentation). The clarified stream is referred to as "clarified juice." The juice is then evaporated to a thick syrup (known as "evaporated juice" or "thick juice"), and crystallized in a vacuum pan. The "massecuite" (i.e., mixture of sugar syrup and crystals) produced in the vacuum pan is stirred in a crystallizer, and the mother syrup is spun off from the raw sugar crystals in a centrifugal separator. The solid sugar in the centrifugal basket is washed with water to remove remaining syrup. The solid crystalline product is termed "raw sugar." The syrup remaining after multiple stages of crystallization and centrifugation is referred to as "cane mill molasses" and is typically used for animal feed or fermentation syrups.

Raw sugar from the mill is usually transported to a sugar refinery for further processing. In a conventional cane sugar refining process, the raw sugar is first washed and centrifuged to remove adherent syrup, and the "affined sugar" thus produced is dissolved in water as "melter liquor." The syrup removed from the surface of the raw sugar is known as "affination syrup" and is broadly similar in composition to the mother syrup from the raw sugar crystallization. The affination syrup is processed in a "recovery section" through a series of vacuum pans, crystallizers and centrifugal separators similar to those used for the production of raw sugar, to recover an impure crystalline sugar product which has approximately the same composition as raw sugar. This recovered sugar product is dissolved in water, along with the affined raw sugar, to make melter liquor. The syrup remaining after the multiple stages of crystallization and centrifugation is referred to as "cane refinery molasses," and is typically used for animal feed or fermentation syrups.

The melter liquor is purified, generally by the successive steps of clarification and decolorization, and the resulting "fine liquor" is crystallized to give refined sugar (also known as "white sugar"). The clarification step usually involves forming an inorganic precipitate in the liquor, and removing the precipitate and along with it insoluble and colloidal impurities which were present in the melter liquor. In one of the clarification processes commonly used for melter liquor, termed "carbonatation" or "carbonation," the inorganic precipitate is calcium carbonate, normally formed by the addition of lime and carbon dioxide to the liquor. The calcium carbonate precipitate is usually removed from the liquor by filtration. Another clarification process, termed phosphatation, involves adding lime and phosphoric acid to the liquor, producing calcium phosphate precipitate.

The molasses produced in cane mills and refineries contains a substantial concentration of sucrose (e.g., 35–55% by weight on a dry solids basis). However, that sucrose cannot be recovered readily by additional crystallizations, because the molasses contains such a high concentration of impurities, including invert sugars (a mixture of glucose and fructose). The sucrose in the molasses could be sold for a far higher price than the molasses, if only the sucrose could be separated from the other constituents of the molasses in an economical way. However, the prior art has failed to provide a practical and cost-effective way to make this separation for cane syrups where invert is a significant component.

Chromatographic separation is used to desugar beet molasses and has been proposed for cane, but beet molasses has no invert and it is more straightforward to separate the sucrose. Chromatographic separation is an expensive process for cane.

Conventional dead end filtration is incapable of separating sucrose from macromolecular impurities in cane juice. Several methods of using microfiltration and ultrafiltration for purification of juice with reduced lime use have been reported, but these methods generally involve inserting microfiltration or ultrafiltration membranes into the conventional can process at one or more points.

There is a long-standing need for improved processes for obtaining sugar from cane that avoid or at least minimize one or more of the problems existing in the previously used processes.

SUMMARY OF THE INVENTION

The present invention relates to a process for producing sugar from cane. A sucrose-containing feed juice that has been obtained from sugar cane is filtered through a first ultrafiltration membrane that has a first molecular weight cutoff. This ultrafiltration step produces a first ultrafiltration permeate and a first ultrafiltration retentate. The first ultrafiltration permeate is filtered through a second ultrafiltration membrane that has a second molecular weight cutoff that is lower than the first molecular weight cutoff. This second ultrafiltration step produces a second ultrafiltration permeate and a second ultrafiltration retentate. The second ultrafiltration permeate is nanofiltered through a nanofiltration membrane, thereby producing a nanofiltration permeate and a nanofiltration retentate. The nanofiltration retentate has a higher concentration of sucrose on a dry solids basis than the feed juice introduced into the first ultrafiltration step, and can be used in evaporation and crystallization operations to produce crystals of white sugar.

In one embodiment of the invention, the sucrose-containing feed juice is manufactured by macerating sugar cane or pieces thereof, thereby producing a macerated material that comprises pulp and liquid, and then separating the liquid in the macerated material from the pulp, for example by one or more of centrifugation, conventional filtration, or screening. In one particular embodiment, the cane is macerated by first passing it through a hammer mill, and optionally it can subsequently be passed through a grinder, whereby the cane is converted into a mixture of pulp and sucrose-containing liquid. Preferably, no more than about 5% by weight of the sucrose present in the cane remains in the pulp after the liquid is separated therefrom, more preferably no more than about 3%.

After separation of the fibrous pulp from the liquid, and before the first ultrafiltration, the process can optionally include an additional step or steps to remove residual beet cane and silt from the separated liquid (juice). This can be done by screening and/or filtration. Preferably the screening or filtration removes at least 90% by weight of all fibers and silt having a largest dimension of about 150 $\mu$m or greater, more preferably at least 90% by weight of all fibers and silt having a largest dimension of about 50 $\mu$m or greater.

It is preferred to adjust the pH of the feed juice to about 6–8, for example by the addition of a base, prior to ultrafiltration. This can help minimize formation of invert.

The first ultrafiltration membrane preferably has a molecular weight cutoff between 2,000 daltons and a pore size no greater than about 0.2 microns. More preferably, it has a molecular eight cutoff of about 4,000–200,000 daltons. The first ultrafiltration permeate preferably has a color of about 3,000–15,000 icu. (All color values given herein are determined on an ICUMSA scale.)

The process of the present invention can be operated at a number of different process conditions. As representative examples of such conditions, the feed juice can be at a temperature of about 140–200° F. during the first ultrafiltration, more preferably about 160–185° F.

The second ultrafiltration membrane preferably has a molecular weight cutoff of about 500–5,000 daltons, more preferably about 1,000–4,000 daltons. In one particular embodiment of the process, the second ultrafiltration is performed in two stages, the first stage using an ultrafiltration membrane having a molecular weight cutoff of about 3,500–4,000 daltons, and the second stage using an ultrafiltration membrane having a molecular weight cutoff of less than about 3,500 daltons. The second ultrafiltration permeate preferably has a color no greater than about 8000 icu, more preferably no greater than about 4000 icu.

In order to minimize loss of sucrose in the retentate from the first and second ultrafiltration steps, it is preferable to include diafiltration steps in the process. "Diafiltration" is used herein to mean ultrafiltration that employs added water in the feed to help flush sucrose through the membrane.

In one such embodiment of the process, the first ultrafiltration retentate is diafiltered through at least a first diafiltration/ultrafiltration membrane. This produces a first diafiltration permeate and a first diafiltration retentate. The first diafiltration permeate is then combined with the first ultrafiltration permeate and filtered through the second ultrafiltration membrane.

Similarly, the retentate from the second ultrafiltration can be diafiltered through at least a second diafiltration/ultrafiltration membrane. This second diafiltration step produces a second diafiltration permeate and a second diafiltration retentate. The second diafiltration permeate is then combined with the second ultrafiltration permeate and subsequently filtered through the nanofiltration membrane.

The retentates from the first and second ultrafiltrations (or diafiltrations) and the nanofiltration permeate can be combined to produce molasses. This combined stream may need to be concentrated by evaporation of water.

In addition to purification of the juice by nanofiltration, it is possible to include in the process ion exchange and/or electrodialysis purification steps. These three purification methods can be used in any sequence. In one particularly preferred embodiment of the process, the nanofiltration retentate is purified by electrodialysis, thereby producing a electrodialyzed juice and an electrodialysis residue, and then the electrodialyzed juice is purified by ion exchange, thereby producing a purified juice. Preferably, no lime and no carbon dioxide are contacted with any of the permeates.

The nanofiltration removes ash (including mono- and divalent cations), invert, organic acids, nitrogenous material and other low molecular weight organic or charged compounds. The nanofiltration and the optional electrodialysis and/or ion exchange preferably remove at least about 65% by weight of the Ca, Mg, K, Na and their associated inorganic and organic anions that are present in the second ultrafiltration permeate. The ion exchange replaces remaining divalent cations such as calcium and magnesium with monovalent cations such as potassium and sodium. Preferably, the nanofiltration retentate has a lower concentration of divalent cations on a dry solids basis than the second ultrafiltration permeate.

The nanofiltration permeate will contain a large percentage of the impurities that were present in the feed juice. For example, in many instances, the nanofiltration permeate will comprise at least about 30% by weight on a dry solids basis of the ash, and at least about 30% of the invert.

The purified juice (i.e., after nanofiltration and any electrodialysis and/or ion exchange), preferably has an ash concentration of no greater than about 2.5% by weight on a dry solids basis, more preferably no greater than about 2%, most preferably no greater than about 1.0%.

After the membrane filtration steps (and any electrodialysis and/or ion exchange), water can be evaporated from the purified juice to produce a concentrated syrup (e.g., 75% dry solids). White sugar can then be crystallized from the concentrated syrup. Because of the high degree of removal of impurities, the present invention can achieve two crystallizations of white sugar from the concentrated syrup.

A mother liquor will remain after one or more crystallizations of white sugar from the concentrated syrup. This mother liquor can be recycled to the second ultrafiltration. Optionally, this recycle stream can be further purified to reduce its ash and colour.

The process can optionally include sulfitation of one or more process streams. In particular, at least one aqueous stream selected from the group consisting of the feed juice, the first ultrafiltration permeate, the second ultrafiltration permeate, the nanofiltration retentate, and the evaporator feed can be contacted with an agent selected from the group consisting of sulfur dioxide, sulfite salts, bisulfite salts, metabisulfite salts, dithionites, and mixtures thereof, in an amount sufficient to provide an equivalent concentration of sulfur dioxide in the stream of at least about 100 ppm.

One particularly preferred embodiment of the invention is a process for producing sugar from cane that comprises the steps of:

(a) macerating sugar cane or pieces thereof, thereby forming pulp that comprises sucrose-containing aqueous liquid;

(b) separating the sucrose-containing liquid from the pulp;

(c) filtering the sucrose-containing liquid through a first ultrafiltration membrane that has a molecular weight cutoff of about 4,000–200,000 daltons, thereby producing a first ultrafiltration permeate that has a color no greater than about 15,000 icu and a first ultrafiltration retentate;

(d) filtering the first ultrafiltration permeate through a second ultrafiltration membrane that has a molecular weight cutoff of about 2,000–4,000 daltons, thereby producing a second ultrafiltration permeate that has a color no greater than about 8,0004,000 icu and a second ultrafiltration retentate;

(e) filtering the second ultrafiltration permeate through a nanofiltration membrane; thereby producing a nanofiltration permeate and a nanofiltration retentate, wherein the nanofiltration retentate has a higher concentration of sucrose on a dry solids basis than the sucrose-containing liquid in step (b);

(f) purifying the nanofiltration rententate by at least one method selected from the group consisting of ion exchange and electrodialysis, thereby producing an evaporator feed;

(g) evaporating water from the evaporator feed to produce a concentrated syrup; and (h) crystallizing white sugar from the concentrated syrup.

Optionally, this embodiment of the process can further comprise the steps of:

(i) crystallising a mother liquor from the first crystallisation to produce white sugar;

(j) treating the mother liquor from the second crystallisation by chromatographic separation; and (k) recycling the treated mother liquor back to the nanofiltration feed or the evaporator feed.

The various aspects of the present invention have a number of advantages over prior art cane processes. For example, the process of the present invention eliminates the need for producing raw sugar, and then having to redissolve or melt and refine this raw sugar. The present invention allows elimination of the carbonation process, and reduces the energy used because refining is eliminated.

The present invention provides a cost-effective way of reducing the ash content of the cane juice or syrup, preferably to about 2.5% or less (on a dry solids basis), more preferably to about 1.5% or less, most preferably to about 1% or less. This reduction in ash content is important because it allows a second strike of sucrose crystals from the syrup. In prior art cane processes, ash contents in the range of 6.0% made it practically impossible to have more than one strike of sucrose crystals.

In addition, the present invention can eliminate the need for desugarization of molasses streams. The efficient membrane filtration steps prevent excessive amounts of sucrose from entering the molasses streams in the first place.

Further, the present invention provides an economical and reliable method for removing color-causing materials from cane juice.

DETAILED DESCRIPTION OF SPECIFIC EMBODIMENTS

Figure 1:
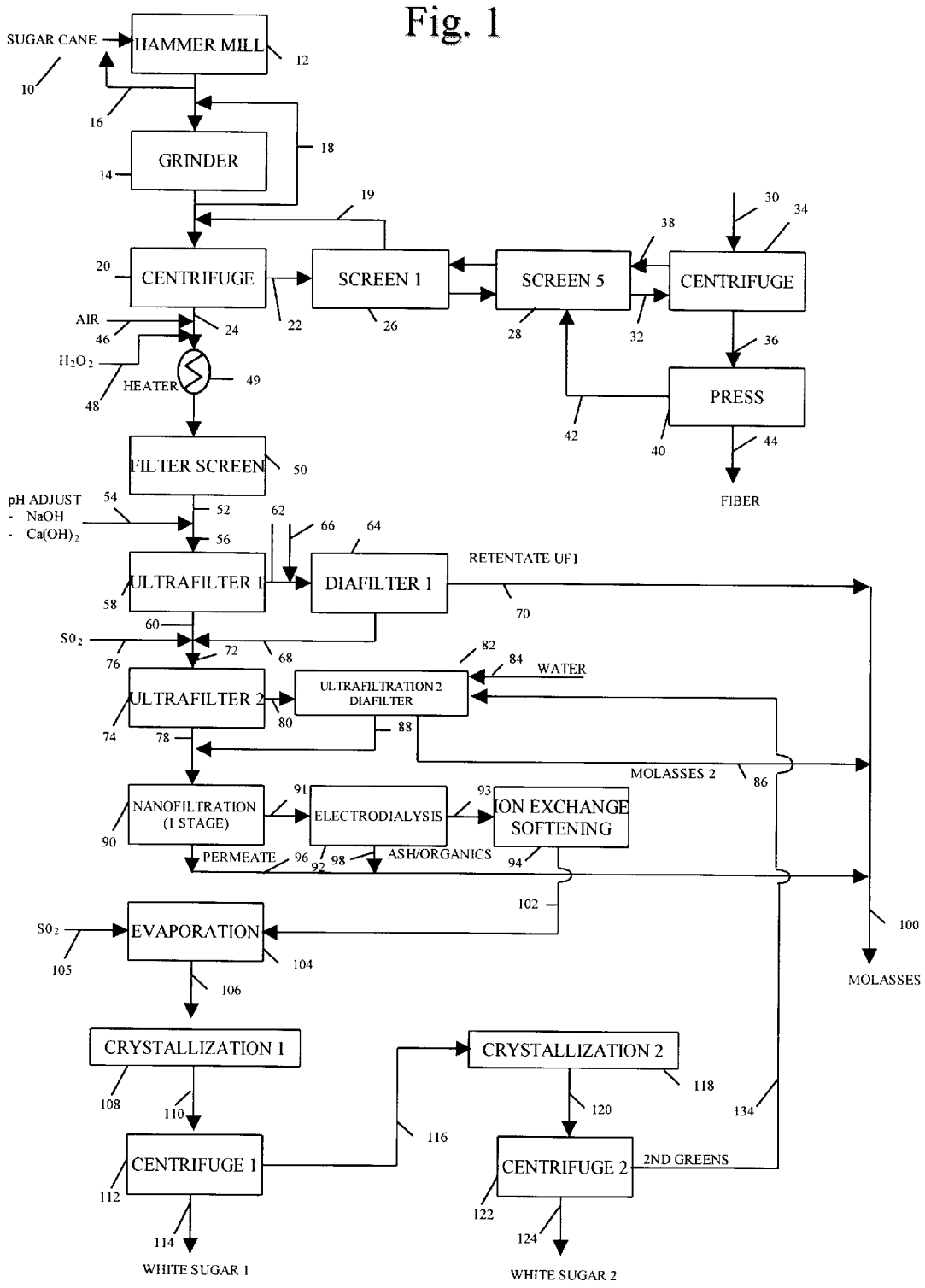
FIGS. 1 and 2 are a process flow diagrams showing embodiments of the present invention in which sucrose is obtained from sugar cane.

The present invention provides an improved method for obtaining sucrose from sugar cane. Although the process of the present invention can be operated in batch mode, it is especially well suited for continuous operation. One embodiment of the invention is shown in FIG. 1. Sugar cane received from the field is kept in a storage area 10.

The cane is carried by conveying apparatus to macerating apparatus. The macerating apparatus can comprise, for example, one or more hammer mills 12 and one or more grinders 14. Suitable hammer mills can use a set of swinging blades mounted on a vertical shaft, which force the cane material through a discharge screen. Another suitable type of hammer mill uses fixed blades. Another suitable macerating apparatus comprises one or more attrition mills that use discs as the primary attrition device. The discs preferably have grooves therein to facilitate maceration, and the discs can be horizontal or vertical in positioning. It is also possible to use both disc mills and hammer mills in series (e.g., hammer mill followed by disc attrition mill) or to have only one type of mill, a hammer mill.

Partially macerated cane exiting the hammer mill 12 can be passed through the grinder 14, in which the cane material is further macerated. The macerated material leaving the grinder comprises pulp (i.e., fibrous material from the cane) and aqueous liquid that contains sucrose as well as other substances. Juice side streams 16 and 18 can be taken from the output of the hammer mill 12 and the grinder 14 and recycled into the feed to those devices. This increases the flow of liquid through the hammer mill 12 and the grinder 14 and helps carry along the solid portion of the cane.

The macerated material leaving the grinder 14 is passed through a separator 20 for separation of the liquid from the fibrous pulp. The separator 20 can suitably be a centrifuge, filter, or screen (e.g., a rotating or vibrating screen, or a Dorr-Oliver DSM screen), or a combination of two or more of these. In the embodiment of the process shown in FIG. 1, the separator 20 comprises a centrifuge, which produces a pulp stream 22 and a juice stream 24. The pulp is passed through a series of screens 26 and 28, with a counter-current flow of aqueous liquid helping to remove residual sucrose from the pulp. These can be rotating, vibrating screens, or DSM screens. The counter-current flow is established by introducing a water stream 30 into a centrifuge 34 at the other end of the series of screens. The pulp stream 32 exiting the final screen 28 then passes into the centrifuge 34, in which it is separated into a low-water pulp material 36 and a recovered juice 38, with the latter being routed in counter-current flow to the pulp through the series of screens 28 and 26. This centrifuge 34 desweetens the pulp. A liquid 19 can be drawn from one of the screens, usually the first screen, and fed into the juice stream before the centrifuge 20. Optionally anti-foam can be added to the juice and fibre streams to reduce foaming.

The low water pulp 36 has some of its remaining water and sucrose removed in a press 40. The aqueous stream 42 from the press 40 is recycled into one of the screens 28. The residual fiber or bagasse 44 that remains after pressing can be burned in the boiler providing steam for the factory.

The juice stream 24 exiting the centrifuge 20 can optionally have an air stream 46 injected into it. This will oxidize color-forming materials in the juice which aids in the formation of polymerised color bodies and thereby facilitates removal of the color bodies in the subsequent ultrafiltration. It is also possible to inject a stream 48 of hydrogen peroxide solution, in addition to or instead of injecting air. The hydrogen peroxide also assists oxidation and polymerisation of color-forming materials. Alternatively, ozone could be injected in place of hydrogen peroxide. The temperature of the juice is preferably increased at this point in the process by a heater 49, preferably to about 140–200° F., more preferably about 160–185° F.

Optionally, the heated juice can be pre-filtered prior to the first ultrafiltration, in order to reduce its already low fiber content. The pre-filtration can be done, for example, with a rotating or vibrating screen 50. Preferably, the filter or screen 50 has a mesh size of about 30–100 microns, and removes the majority by weight of the fiber and silt remaining in the juice.

The heated and screened juice 52 can optionally have its pH adjusted by addition of a stream 54 that comprises, for example, aqueous sodium hydroxide, calcium hydroxide, or potassium carbonate. This pH adjustment helps prevent the inversion of sugars which can take place at elevated temperatures. Other chemicals may be also be used for pH adjustment, such as liquid potassium hydroxide or granular sodium or potassium carbonate. Preferably the pH of the juice after this step is between about 6.0–8.0, more preferably between about 6.5–7.5.

The juice after the pH adjustment, referred to herein as the ultrafiltration feed juice 56, is brought into contact with a first ultrafiltration membrane 58. This first ultrafiltration membrane is preferably tubular or spiral and preferably has a molecular weight cutoff of between about 2,000 daltons and a pore size no greater than about 0.2 microns, more preferably having a molecular weight cutoff between about 4,000–500,000 daltons, most preferably between about 10,000–200,000.

The ultrafiltration step produces a first ultrafiltration permeate 60 and a first ultrafiltration retentate 62. In this embodiment of the process, the first ultrafiltration retentate 62 is then fed to a first ultrafiltration/diafiltration membrane 64 with addition of water 66. This ultrafiltration/diafiltration membrane can suitably have a pore size/molecular weight cutoff that is approximately the same as the first ultrafiltration membrane 58. This first diafiltration 64 produces a first diafiltration permeate 68 and a first diafiltration retentate 70 (also referred to as the molasses 1 stream). The diafiltration minimizes the amount of sucrose lost in the molasses (i.e., the concentration of sucrose on a dry solids basis (dsb) is lower in the retentate 70 than in the feed 62). It should be understood that there could be several stages of ultrafiltration 58 and/or diafiltration 64.

The first ultrafiltration permeate 60 typically will have a color of about 3,000–15,000 icu. The first ultrafiltration permeate 60 and the first diafiltration permeate 68 are combined to form the feed 72 for a second ultrafiltration membrane 74.

Prior to the second ultrafiltration, a sulfitation stream 76 can be injected into the juice 72. This stream 76 can comprise, for example, sulfur dioxide, or sulfite, bisulfite, metabisulfite, or dithionite salts, such as aqueous ammonium bisulfite or sodium bisulfite (e.g., at about 35–65% concentration). Preferably, the residual level of sulfur dioxide in the juice after sulfitation is at least about 100 ppm. The sulfitation can take place at one or more points in the process, for example, at the time of macerating the cane, in the juice after it is separated from the pulp, in the feeds to the first or second ultrafiltrations or to the nanofiltration, and/or in the feed to the evaporator. Most preferably, the sulfitation is done in the feed to the second ultrafiltration. This sulfitation will prevent the color increase that can otherwise take place during membrane filtration and evaporation operations. Other antioxidants may also be used.

The second ultrafiltration membrane 74 preferably has a molecular weight cutoff of about 500–5,000, more preferably about 2,000–4,000. The second ultrafiltration produces a second ultrafiltration permeate 78 and a second ultrafiltration retentate 80. The retentate 80 is then mixed with second greens 134, the mother liquor recycled from the second white sugar crystallisation, and passed through a second ultrafiltration/diafiltration membrane 82 with added water 84. The membrane used for the second diafiltration can suitably have a pore size/molecular weight cutoff that is similar in pore size to the second ultrafiltration membrane 74. This step produces a second diafiltration permeate 88, which is mixed with the second ultrafiltration permeate 78 and fed to a nanofilter 90, and a second diafiltration retentate 86 (also referred to as the molasses 2 stream). There could be more than one stage of membrane filtration in the second ultrafiltration 74 and/or the second diafiltration 82. The permeate 78 from the second ultrafiltration preferably will have color in the range of 1,500–6,500, or in some cases even less.

Optionally, the second diafiltration permeate 88 and/or the first diafiltration permeate 68 can be recycled into the diafiltration water streams.

Figure 2:
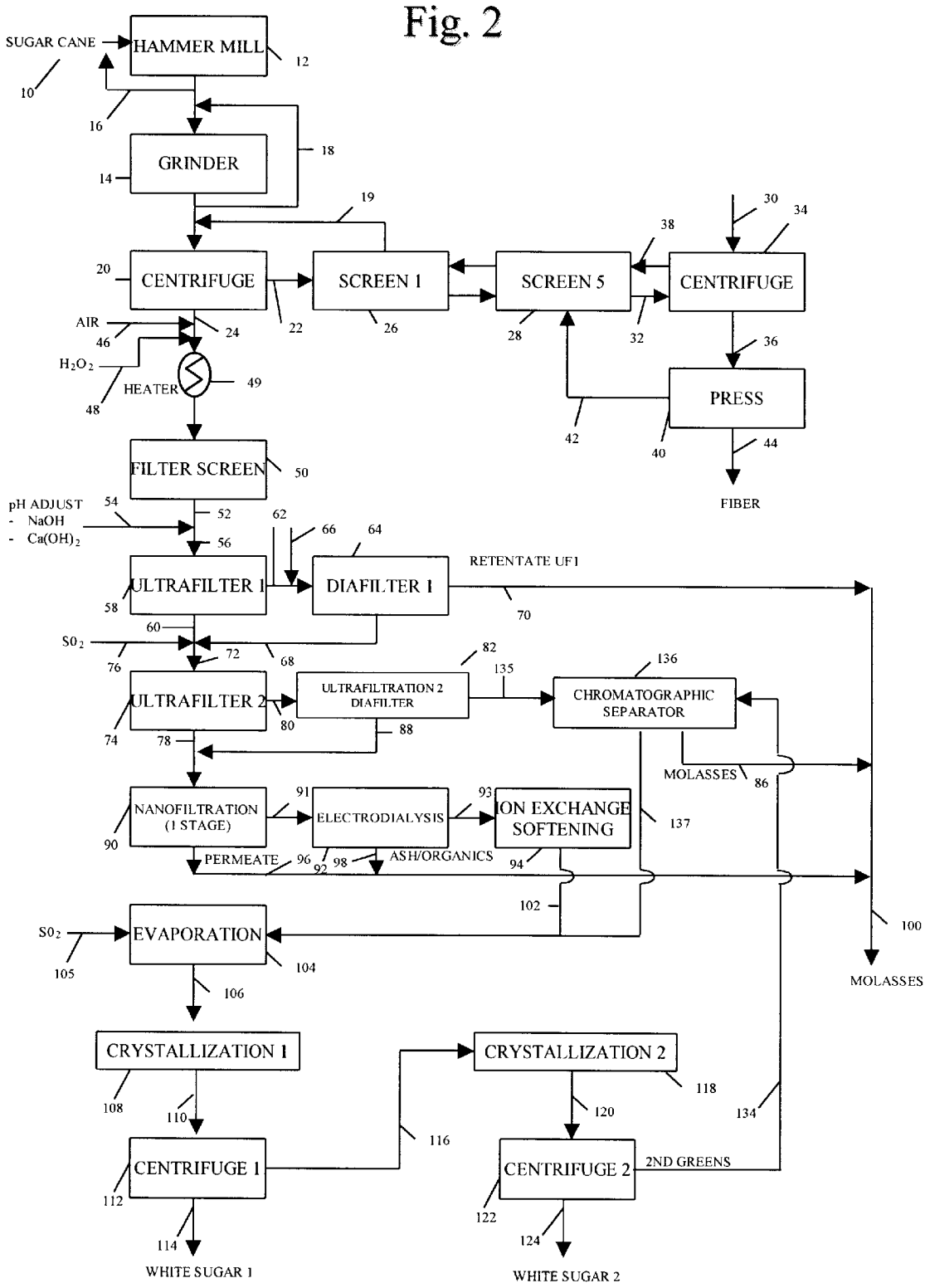

Alternatively, or in addition to ultrafiltration/diafiltration, the retentate 135 can be mixed with the greens 134 and purified by a chromatographic separation in a simulated moving bed separator system. This alternative is shown in FIG. 2. This chromatographic separator 136 preferably is a multistage unit with from three to twenty stages, more preferably ten stages. It preferably has three product cuts, one being predominantly sucrose, stream 137, another being predominantly ash and color, stream 86, and the third being predominantly organic material including invert and organic acids. The two non-sucrose streams can be mixed to give stream 86 (referred to as molasses 2). The resin used in the separator preferably is a strong acid cationic resin. The sucrose stream 137 is mixed with the feed to the evaporator 104. Alternatively, it could be added to the feed of the electrodialysis 92, or to the feed to the ion exchange 94, depending on the degree of removal of impurities.

The second ultrafiltration permeate 78 is then purified by nanofiltration, and optionally also ion exchange and/or electrodialysis, in any sequence. In the embodiment shown in FIG. 1, the ultrafiltered juice 78 is first nanofiltered 90, followed by electrodialysis 92 and ion exchange softening 94. Although the sequence of these three operations can be varied, it is usually preferable to perform electrodialysis after nanofiltration.

The feed to the nanofiltration membrane typically comprises about 80–84% sucrose, 3–8% ash, and about 0.5–4.0% invert sugar (all by weight on dsb). The nanofiltration membrane 90 separates the feed into a nanofiltration permeate 96 (also referred to as the molasses 3 stream) and a nanofiltration retentate 91 which will contain most of the sucrose from the cane. The nanofiltration permeate preferably contains at least about 30–60% by weight of the ash (primarily Na, K, and Cl), and at least about 30–50% by weight of the invert (glucose and fructose) present in the nanofiltration feed 78. The nanofiltration will accomplish some color reduction from the nanofiltration feed to the retentate. A typical nanofiltration permeate will comprise 15% sucrose, 25% ash, 25% invert, and 35% other organics (dsb). Preferably, the nanofiltration retentate 91 will contain at least about 84–91% by weight (dsb) sucrose and will have a concentration of about 15–28 Brix. Although nanofiltration can effectively remove potassium, it does not remove a large percentage of the citric, oxalic, and malic acid that is present.

The nanofiltration retentate 91 is then further purified by electrodialysis 92, which removes additional ash and various organic acids and other impurities, including some that cause undesirable color. Electrodialysis provides good removal of oxalic acid and malic acid, with the total ash removal typically being over 40%. The impurity stream 98 from the electrodialysis is combined with the streams 70, 86, and 96, to form a molasses product stream 100.

Although electrodialysis can achieve good removal of potassium, it does not typically remove a high percentage of the calcium and magnesium that is present. Therefore, the purified juice 93 from electrodialysis (which will typically contain about 90–94% sucrose dsb) preferably is then softened by ion exchange unit 94 which contains at least one ion exchange resin. A strong cation exchange resin based on a gel or macro-porous matrix, with cross-linking ranging from 4 to 10%, is preferred. Examples of these are resins such as Rohm & Haas Amberlite IR120, or Purolite C 100. These will be used in the sodium or potassium form. The primary purpose of this step is to remove divalent cations, such as Ca and Mg, and replace them with monovalent cations, such as K and Na. This ion exchange step preferably removes at least about 95% by weight of the Ca and Mg present.

The purified juice 102 from the ion exchange, which preferably comprises more than about 90% sucrose (dsb), is then fed to one or more evaporators 104, in which a concentrated syrup 106 is formed (e.g., about 75% dry solids) by removal of substantial quantities of water. Optionally, a sulfitation stream 105 can be injected into the evaporator. Preferably, the syrup will have a pH of about 6.5–7.5 and a temperature of about 160–180° F. during evaporation.

The concentrated syrup 106 is fed to a first crystallizer 108, in which water is boiled off and a first strike of white sugar crystals 110 is formed. The crystals 110 are centrifuged 112, washing with a water spray, to remove any residual liquid, and the remaining product is white sugar 114 (sucrose concentration of about 99.95%). The mother liquor 116 remaining after the first crystallization and centrifugation (typically containing about 84–88% sucrose dsb) is fed to a second crystallizer 118, in which a second strike of white sugar crystals 120 is formed. The crystals are also centrifuged 122 to produce white sugar 124. The present invention can achieve two strikes of highly pure white sugar, due to its improved purification capabilities. In a preferred embodiment, the crystallized sucrose (114 and 124) will comprise less than about 0.015% by weight ash, more preferably less than about 0.01% ash, and a color less than about 50 iu, more preferably less than about 35 iu.

The mother liquor 134 remaining after the second crystallization (also referred to as "greens" or "jets", and typically containing about 80% sucrose dsb) can be recycled, for example into the second ultrafiltration/diafiltration 82. Optionally, this greens recycle stream may be routed through a purification unit to remove ash, invert and color (also resulting in dilution of the greens to about 60 RDS. Preferably if this purification 128 is included in the process, the invert concentration in the greens is decreased to a level no greater than about 5.0% dsb.

The process of the present invention can include multiple stages of ultrafiltration, nanofiltration, diafiltration, ion exchange, and/or electrodialysis. For example, the first ultrafiltration shown in FIG. 1 could take place in two or more stages of ultrafiltration, rather than taking place through a single membrane. Those skilled in the art will recognize that many other variations on the specific embodiment shown in the figure are also possible. It should also be recognized that the process can be operated at a variety of temperatures and other process conditions.

A variety of membrane configurations can be used in the present invention, including for example spiral, hollow fiber, and tubular membranes. These membranes can be made from a various materials including polymers, ceramics, carbon and sintered stainless steel. Membranes that have a negative surface charge are preferred since most compounds to be rejected are negatively charged.

Some of the equipment used in the process is conventional and well known to persons of ordinary skill in this field, such as sugar crystallising equipment and evaporators. Macerating apparatus is commercially available from suppliers such as Bepex Reitz (Santa Rosa, Calif.), Andriz Sprout Bauer (Philadelphia, Pa.) and The Fitzpatrick Company (Elmhurst, Ill.). Centrifugal extraction apparatus is available from Dorr Oliver (Milford, Conn.), Western States Machine Company (Hamilton, Ohio), and Silver-Weibull (Hasslehom, Sweden). Suitable membrane filtration systems are available from suppliers such as Koch Membrane Systems, Inc. (Wilmington, Mass.), Osmonics, Inc. (Minnetonka, Minn.), PCI (UK), and SCT (France). Suitable ion exchange equipment and resins are available from Prosep (Roscoe, Ill.), IWT (Rockford, Ill.), Purolite (Philadelphia, Pa.), and Dow Chemical (Midland, Mich.). Suitable electrodialysis equipment is available from Eurodia (Paris, France) and Ameridia (Somerset, N.J.).

It would also be possible to include in the process a treatment with some amount of lime and/or carbonation. However, it is presently preferred to operate the process without the use of either lime or carbonation.

EXAMPLE 1a

Cane billets were shredded with a Vermeer Model 1800 Brush Chipper. The shredded cane was fed into a Rietz Disintegrator hammer mill at 200 kg/hour, and from there to an Andriz Sprout-Bauer grinder to provide a well macerated pulp. This fibre and juice was passed to a centrifuge, a Mercone manufactured by Dorr-Oliver which was fitted with a 120 micron conical screen.

Hot water was introduced at the centrifuge inlet, at about 2 gpm to provide a counter current wash. This centrifuge desweetened the fibre providing a residual cane fibre containing 5.5% sugar and 76.2% water. Juice was recycled from the centrifuge through the grinding system and the entire system was maintained at 65–70° C. About 250 ppm on cane of antifoam oil (KABO 580) was added to the juice. The juice was adjusted to 70° C., pH adjustment was carried out by adding sodium hydroxide solution to the maceration stage, and the final juice was pH trimmed as necessary. The final juice from the macerated cane was at 6.5 RDS (refractometric dry solids) and pH 6.2 (measured at ambient temperature). The apparent purity (Pol/Brix) was 78.8; conductivity ash 3.9% and colour 12,283 icu. It contained no fibre.

EXAMPLE 1b

The juice from Example 1a, at about 150° F. (65° C.), was fed to the first ultrafiltration. This was an Osmonics PW 4 inch spiral membrane module having a molecular weight cut off of 10,000 Daltons, and a surface area of 4.2 $m^2$. The inlet pressure averaged 125 psi, the outlet 105 psi, and the cross flow rate was 220 liters/minute. The permeate flow rate was 1.9 liters/minute (corresponding to 27 Liters/square meter/hour). The feed juice was 78 purity at 7.8 RDS and the permeate was 6.8 RDS; pH 6.5; purity 80; colour 11,800 icu, and ash 6.4%.

EXAMPLE 1c

The permeate from the first ultrafiltration system was fed at about 60° C. to a second ultrafiltration system which comprised two 4 inch spiral Koch 328 membranes having a molecular weight cut off of 4000 Daltons, with a total surface area of 12 square meters. The inlet pressure averaged 200 psi, the outlet 175 psi. The total permeate flow rate averaged 2.4 liters/minute giving 12 Liters/square meter/hour. The feed was at 7.1 RDS and 79.3 purity, and the permeate was 5.2 RDS; pH 6.3; 78.6 purity; color 6740 icu, and conductivity ash 8.1%. The retentate was 12.9 RDS, 71 purity and 35,400 iu color.

EXAMPLE 1d

The permeate from the first ultrafiltration, as prepared in Example 1b, was fed at about 60° C. to a second ultrafiltration system which comprised of a Osmonics GK membrane having a molecular weight cut off of 2000 Daltons. The inlet pressure was 225 psi, the feed was at 13.9 RDS and 79.3 purity, and the permeate was at 13.5 RDS, color 4200 icu.

EXAMPLE 1e

The product stream from the second ultrafiltration was treated by nano filtration with 2 stages of Desal 5DL membranes. The total membrane surface was 12 square meters, and the inlet pressure 500 psi, and temperature 57° C. The feed flow was 5.8 liters/min, the retentate flow was 1.15 liters/min., and the permeate flow was 6 liters/minute.

The retentate (product) stream was 26.7 RDS; 84.8 purity; colour 7100 icu and 4.2% ash. The permeate was 0.4 RDS; 4.4 purity; 3083 colour and 26.7% ash.

These HPLC compositions of the streams were:

| | Sucrose | Glucose | Fructose |
|---|---|---|---|
| Feed | 79.2 | 2.8 | 3.7 |
| Permeate | 4.4 | 8.5 | 13.0 |
| Retentate | 84.8 | 1.94 | 2.7 |

EXAMPLE 1f

The product stream from the nanofilter at 26.7 RDS was evaporated to give a syrup at 68 Brix. Approximately 1 ml/minute of ABS solution was added to the feed juice to the evaporator. The evaporator was a single effect APV plate and frame unit, and was operated at 8 psia and the syrup temperature was about 85° C.

EXAMPLE 1g

The syrup (at 67 Brix) from the evaporator after nanofiltration was passed over a cation exchange resin (Purolite C101) in the sodium form. 1 liter of resin was used at 1.6 Bed volumes/hour and at 70° C. 15 Bed Volumes of syrup were treated giving a product at 65 RDS. The ionic composition of the resin input and output streams was:

| | Ca | Mg | K | Na | Ash |
|---|---|---|---|---|---|
| Feed | 0.09% | 0.10% | 1.06% | 0.61% | 5.1% |
| Product | 0.005% | 0.005% | 0.21% | 1.40% | 4.8% |

EXAMPLE 1h

The liquor produced by the evaporator was crystallised under vacuum to give white sugar with colour 30 icu and a conductivity ash of 0.01%. The crystallisation was carried out in batch mode, in a crystalliser containing 1 liter of massescuite. The crystalliser was a laboratory unit constructed from glass equipment. Crystallisation pressure and temperature were 21 in Hg abs and 70–75° C. and crystallisation took 2 hours. The massecuite formed by crystallisation was centrifuged on a 6 inch basket centrifuge using a perforated basket.

EXAMPLE 2

The product from the nanofiltration prepared as in Example 1e above was 25 RDS, 3.83% as conductivity ash and 6700 icu colour. It was treated by electrodialysis in a stack comprising 7 cationic/anionic membrane pairs; each pair had 0.02 $m^2$ of membrane surface. The membranes used were manufactured by Tokuyama Corp of Japan, and the anion membrane was AE506sb, and the cation membrane was CMXsb. The experiment was carried out in batch. The stack operated at 50° C. at a constant voltage 0.8 Volt/cell, while the current varied between 2.8 and 0.14 amps over the duration of the experiment (140 minutes). The anolyte and catholyte systems contained dilute sodium chloride acid (20 mS/cm conductivity) which circulated through the stack at 300 l/h. The solution being treated (1.5 l) circulated at 180 l/h, and was recycled to the feed tank (batch operation). The concentrate solution (2 l) was 0.5% sodium chloride solution and was circulated at 180 l/h. The electrodialysed product had 0.16% conductivity ash (calculated from the cation composition as shown below where the ionic composition of the feed and product is expressed as % ions on solids).

| | Ca | Mg | K | Na | Cation Ash |
|---|---|---|---|---|---|
| Feed | 0.11 | 0.09 | 0.85 | 0.68 | 1.73 |
| Product | 0.03 | 0.00 | 0.01 | 0.05 | 0.06 |

EXAMPLE 3

A liquor produced at a lower purity and equivalent to the mother liquor of the first crystallisation was crystallised under vacuum to give white sugar with colour 70 icu and a conductivity ash of 0.017%. The crystallisation was carried out in batch mode, in a crystalliser containing 1 liter of massescuite. The crystalliser was a laboratory unit constructed from glass equipment. Crystallisation pressure and temperature were 21 in Hg abs and 70–75° C. and crystallisation took 3 hours. The massecuite formed by crystallisation was centrifuged on a 6 inch basket centrifuge using a perforated basket.

EXAMPLE 4

The juice comprising a mixture of the mother liquor from white sugar crystallisation and the retentate from a second ultrafiltration can be evaporated to 60 RDS and passed at a rate of 0.9 liters/hour over a simulated moving bed separation system, containing 5.8 liters of resin distributed among 10 cells. Water can be injected at 4 liters 1 hour and the system operated at a temperature of 70° C. Three fractions can be collected from the system. One contains most of the sucrose while the impurities are distributed among the other two. Typical properties of these fractions are given in the table below. (Organics represent materials calculated by difference from analytical results.)

| | Flow l/hr | RDS | Sucrose | Invert | Ash | Organics | Colour |
|---|---|---|---|---|---|---|---|
| Feed | 0.9 | 60 | 70.9 | 5.9 | 7.8 | 15.4 | 30000 |
| Organic | 0.7 | 1.1 | 13.0 | 12.5 | 19.1 | 55.3 | 27 |
| Sucrose | 1.84 | 29.3 | 96.0 | 1.2 | 2.8 | 0 | 6000 |
| Raffinate | 2.5 | 8.4 | 14.9 | 17.5 | 24.9 | 42.7 | 90000 |

The sucrose fraction obtained is typically 96% pure and represents a recovery of 92.5% of the input.

The preceding description of specific embodiments of the present invention is not intended to be a complete list of every possible embodiment of the invention. Persons skilled in this field will recognize that modifications can be made to the specific embodiments described here that would be within the scope of the present invention.

What is claimed is:

1. A process for producing sugar from cane, comprising the steps of:

(a) macerating sugar cane or pieces thereof, thereby producing a macerated material that comprises pulp and liquid;

(b) separating the liquid in the macerated material from the pulp to produce a sucrose-containing feed juice that also comprises ash and invert sugars;

(c) filtering the sucrose-containing feed juice through a first ultrafiltration membrane that has a first molecular weight cutoff of at least about 2,000 daltons and a pore size no greater than about 0.2 microns, thereby producing a first ultrafiltration permeate and a first ultrafiltration retentate;

(d) filtering the first ultrafiltration permeate through a second ultrafiltration membrane that has a second molecular weight cutoff that is lower than the first molecular weight cutoff and is between about 500–5,000 daltons; thereby producing a second ultrafiltration permeate and a second ultrafiltration retentate; and (e) filtering the second ultrafiltration permeate through a nanofiltration membrane; thereby producing a nanofiltration permeate and a nanofiltration retentate, wherein the nanofiltration retentate has a higher concentration of sucrose on a dry solids basis than the feed juice in step (c), and wherein the nanofiltration permeate comprises at least about 30% by weight of the ash and at least about 30% by weight of the invert sugars present in the second ultrafiltration permeate.

2. The process of claim 1, further comprising the step of purifying either the second ultrafiltration permeate or the nanofiltration retentate by at least one method selected from the group consisting of ion exchange and electrodialysis.

3. The process of claim 2, wherein the nanofiltration retentate is purified by electrodialysis, thereby producing an electrodialyzed juice and an electrodialysis residue.

4. The process of claim 3, wherein the electrodialyzed juice is softened by ion exchange, thereby producing a softened purified juice.

5. The process of claim 4, wherein the nanofiltration, electrodialysis, and ion exchange remove at least about 65% by weight of the Ca, Mg, K, Na and their associated inorganic and organic anions that are present in the second ultrafiltration permeate.

6. The process of claim 4, further comprising evaporating the purified juice to produce a concentrated syrup, and crystallizing white sugar from the concentrated syrup.

7. The process of claim 6, wherein the purified juice has an ash concentration of no greater than about 2.5% by weight on a dry solids basis.

8. The process of claim 7, wherein the purified juice has an ash concentration of no greater than about 1.5% by weight on a dry solids basis.

9. The process of claim 8, wherein the purified juice has an ash concentration of no greater than about 1.0% by weight on a dry solids basis.

10. The process of claim 6, wherein the process comprises two crystallizations of white sugar from the concentrated syrup.

11. The process of claim 6, wherein a mother liquor remains after crystallization of white sugar from the concentrated syrup, and the mother liquor is recycled to one of the ultrafiltration membranes.

12. The process of claim 4, wherein at least one aqueous stream selected from the group consisting of the feed juice, the first ultrafiltration permeate, the second ultrafiltration permeate, the nanofiltration retentate, and the purified juice is contacted with an agent selected from the group consisting of sulfur dioxide, sulfite salts, bisulfite salts, and mixtures thereof, in an amount sufficient to provide an equivalent concentration of sulfur dioxide in the stream of at least about 100 ppm.

13. The process of claim 3, wherein at least two of the first ultrafiltration retentate, the second ultrafiltration retentate, the nanofiltration permeate and the electrodialysis residue are combined to produce molasses.

14. The process of claim 1, wherein air is introduced into the feed juice prior to the first ultrafiltration to polymerise color bodies.

15. The process of claim 1, wherein the pH of the juice is adjusted to about 6–8 by addition of a base, prior to the first ultrafiltration.

16. The process of claim 1, wherein no more than about 5% of the sucrose present in the cane remains in the pulp after liquid is separated therefrom.

17. The process of claim 16, wherein no more than about 3% of the sucrose present in the cane remains in the pulp after liquid is separated therefrom.

18. The process of claim 1, further comprising the step of removing residual cane fibers and silt from the separated liquid, by at least one method selected from the group consisting of screening and filtration, prior to the first ultrafiltration.

19. The process of claim 18, wherein the screening or filtration removes at least 90% by weight of all fibers and silt having a largest dimension of about 150 $\mu$m or greater.

20. The process of claim 19, wherein the screening or filtration removes at least 90% by weight of all fibers and silt having a largest dimension of about 50 $\mu$m or greater.

21. The process of claim 1, wherein the cane is macerated by passing the cane through a hammer mill, whereby the cane is converted into a mixture of pulp and sucrose-containing liquid.

22. The process of claim 21, wherein the macerated cane is also passed through a grinder.

23. The process of claim 21, wherein liquid is separated from the pulp by centrifugation.

24. The process of claim 1, wherein the first ultrafiltration retentate is diafiltered through at least a first diafiltration/ultrafiltration membrane, thereby producing a first diafiltration permeate and a first diafiltration retentate; and wherein the first diafiltration permeate is filtered through the second ultrafiltration membrane.

25. The process of claim 24, wherein the second ultrafiltration retentate is diafiltered through at least a second diafiltration/ultrafiltration membrane, thereby producing a second diafiltration permeate and a second diafiltration retentate; and wherein the second diafiltration permeate is filtered through the nanofiltration membrane.

26. The process of claim 25, wherein at least the first diafiltration retentate, the second diafiltration retentate, and the nanofiltration permeate are combined to produce molasses.

27. The process of claim 1, further comprising evaporating the nanofiltration retentate to produce a concentrated syrup, and crystallizing white sugar from the concentrated syrup.

28. The process of claim 27, wherein a mother liquor remains after crystallization of white sugar from the concentrated syrup, and the mother liquor is recycled to one of the ultrafiltration membranes.

29. The process of claim 1, wherein the feed juice is at a temperature of about 140–200° F. during filtration through the first ultrafiltration membrane.

30. The process of claim 29, wherein the feed juice is at a temperature of about 160–185° F. during filtration through the first ultrafiltration membrane.

31. The process of claim 1, wherein the first ultrafiltration membrane has a molecular weight cutoff of about 4,000–200,000 daltons.

32. The process of claim 1, wherein the first ultrafiltration permeate has a color of about 3,000–15,000 icu.

33. The process of claim 1, wherein the second ultrafiltration membrane has a molecular weight cutoff of about 1,000–4,000 daltons.

34. The process of claim 1, wherein the second ultrafiltration permeate has a color no greater than about 8,000 icu.

35. The process of claim 1, wherein the second ultrafiltration permeate has a color no greater than about 4,000 icu.

36. The process of claim 1, wherein at least one aqueous stream selected from the group consisting of the feed juice, the first ultrafiltration permeate, the second ultrafiltration permeate, and the nanofiltration retentate is contacted with an agent selected from the group consisting of sulfur dioxide, sulfite salts, bisulfite salts, metabisulfite salts, dithionite salts, and mixtures thereof, in an amount sufficient to provide an equivalent concentration of sulfur dioxide in the stream of at least about 100 ppm.

37. The process of claim 1, where no lime and no carbon dioxide are contacted with any of the permeates.

38. A process for producing sugar from cane, comprising the steps of:

(a) macerating sugar cane or pieces thereof, thereby forming pulp that comprises sucrose-containing aqueous liquid that also comprises ash and invert sugars;

(b) separating the sucrose-containing liquid from the pulp;

(c) filtering the sucrose-containing liquid through a first ultrafiltration membrane that has a molecular weight cutoff of about 4,000–200,000 daltons, thereby producing a first ultrafiltration permeate that has a color no greater than about 15,000 icu and a first ultrafiltration retentate;

(d) filtering the first ultrafiltration permeate through a second ultrafiltration membrane that has a molecular weight cutoff of about 2,000–4,000 daltons, thereby producing a second ultrafiltration permeate that has a color no greater than about 8,000 icu and a second ultrafiltration retentate;

(e) filtering the second ultrafiltration permeate through a nanofiltration membrane; thereby producing a nanofiltration permeate and a nanofiltration retentate, wherein the nanofiltration retentate has a higher concentration of sucrose on a dry solids basis than the sucrose-containing liquid in step (b), and wherein the nanofiltration permeate comprises at least about 30% by weight of the ash and at least about 30% by weight of the invert sugars present in the second ultrafiltration permeate;

(f) purifying the nanofiltration retentate by at least one method selected from the group consisting of ion exchange and electrodialysis, thereby producing an evaporator feed;

(g) evaporating water from the evaporator feed to produce a concentrated syrup; and (h) crystallizing white sugar from the concentrated syrup.

39. The process of claim 38, wherein the process comprises at least two crystallizations of white sugar from the concentrated syrup.

40. The process of claim 38 further comprising introducing sufficient air into the sucrose containing liquid to cause polymerization of color bodies and removing at least some of the color bodies from the juice by membrane filtration through at least one ultrafiltration membrane of nanofiltration membrane.

41. The process of claim 40, further comprising heating the juice prior to said removal to a temperature of about 140–200° F.

42. The process of claim 40, wherein the membrane filtration comprises:

filtering the juice through the first ultrafiltration membrane that has a first molecular weight cutoff, thereby producing a first ultrafiltration permeate and a first ultrafiltration retentate;

filtering the first ultrafiltration permeate through a second ultrafiltration membrane that has a second molecular weight cutoff that is lower than the first molecular weight cutoff; thereby producing a second ultrafiltration permeate and a second ultrafiltration retentate; and filtering the second ultrafiltration permeate through the nanofiltration membrane; thereby producing a nanofiltration permeate and a nanofiltration retentate.

43. The process of claim 38, wherein a mother liquor is produced in the crystallization, and at least 75% by weight of the invert, ash and color is removed from the mother liquor in a simulated moving bed chromatographic separator, and the treated liquor is recycled.

44. The process of claim 43, wherein the recycled liquor is subjected to further purification, evaporation and crystallisation.

45. A process for producing sugar from cane, comprising the steps of:

(a) macerating sugar cane or pieces thereof, thereby producing a macerated material that comprises pulp and liquid;

(b) separating the liquid in the macerated material from the pulp to produce a sucrose-containing feed juice that also comprises ash and invert sugars;

(c) removing residual cane fibers and silt from the feed juice, by at least one method selected from the group consisting of screening and filtration, wherein at least 90% by weight of all fibers and silt having a largest dimension of about 150 $\mu$m or greater are removed;

(d) filtering the sucrose-containing feed juice through a first ultrafiltration membrane that has a first molecular weight cutoff, thereby producing a first ultrafiltration permeate and a first ultrafiltration retentate;

(e) filtering the first ultrafiltration permeate through a second ultrafiltration membrane that has a second molecular weight cutoff that is lower than the first molecular weight cutoff; thereby producing a second ultrafiltration permeate and a second ultrafiltration retentate; and (f) filtering the second ultrafiltration permeate through a nanofiltration membrane; thereby producing a nanofiltration permeate and a nanofiltration retentate, wherein the nanofiltration retentate has a higher concentration of sucrose on a dry solids basis than the feed juice in step (d), and wherein the nanofiltration permeate comprises at least about 30% by weight of the ash and at least about 30% by weight of the invert sugars present in the second ultrafiltration permeate.

46. The process of claim 45, further comprising the step of purifying either the second ultrafiltration permeate or the nanofiltration retentate by at least one method selected from the group consisting of ion exchange and electrodialysis.

47. The process of claim 46, wherein the nanofiltration retentate is purified by electrodialysis, thereby producing a electrodialyzed juice and an electrodialysis residue.

48. The process of claim 47, wherein the electrodialyzed juice is softened by ion exchange, thereby producing a softened purified juice.

49. The process of claim 48, wherein the nanofiltration, electrodialysis, and ion exchange remove at least about 65% by weight of the Ca, Mg, K, Na and their associated inorganic and organic anions that are present in the second ultrafiltration permeate.

50. The process of claim 48, further comprising evaporating the purified juice to produce a concentrated syrup, and crystallizing white sugar from the concentrated syrup.

51. The process of claim 50, wherein the purified juice has an ash concentration of no greater than about 2.5% by weight on a dry solids basis.

52. The process of claim 51, wherein the purified juice has an ash concentration of no greater than about 1.5% by weight on a dry solids basis.

53. The process of claim 52, wherein the purified juice has an ash concentration of no greater than about 1.0% by weight on a dry solids basis.

54. The process of claim 50, wherein the process comprises two crystallizations of white sugar from the concentrated syrup.

55. The process of claim 50, wherein a mother liquor remains after crystallization of white sugar from the concentrated syrup, and the mother liquor is recycled to one of the ultrafiltration membranes.

56. The process of claim 47, wherein at least two of the first ultrafiltration retentate, the second ultrafiltration retentate, the nanofiltration permeate and the electrodialysis residue are combined to produce molasses.

57. The process of claim 48, wherein at least one aqueous stream selected from the group consisting of the feed juice, the first ultrafiltration permeate, the second ultrafiltration permeate, the nanofiltration retentate, and the purified juice is contacted with an agent selected from the group consisting of sulfur dioxide, sulfite salts, bisulfite salts, and mixtures thereof, in an amount sufficient to provide an equivalent concentration of sulfur dioxide in the stream of at least about 100 ppm.

58. The process of claim 45, wherein air is introduced into the feed juice prior to the first ultrafiltration to polymerise color bodies.

59. The process of claim 45, wherein the pH of the juice is adjusted to about 6–8 by addition of a base, prior to the first ultrafiltration.

60. The process of claim 45, wherein no more than about 5% of the sucrose present in the cane remains in the pulp after liquid is separated therefrom.

61. The process of claim 60, wherein no more than about 3% of the sucrose present in the cane remains in the pulp alter liquid is separated therefrom.

62. The process of claim 45, wherein the screening or filtration removes at least 90% by weight of all fibers and silt having a largest dimension of about 50 $\mu$m or greater.

63. The process of claim 45, wherein the cane is macerated by passing the cane through a hammer mill, whereby the cane is converted into a mixture of pulp and sucrose-containing liquid.

64. The process of claim 63, wherein the macerated cane is also passed through a grinder.

65. The process of claim 63, wherein liquid is separated from the pulp by centrifugation.

66. The process of claim 45, wherein the first ultrafiltration retentate is diafiltered through at least a first diafiltration/ultrafiltration membrane, thereby producing a first diafiltration permeate and a first diafiltration retentate; and wherein the first diafiltration permeate is filtered through the second ultrafiltration membrane.

67. The process of claim 66, wherein the second ultrafiltration retentate is diafiltered through at least a second diafiltration/ultrafiltration membrane, thereby producing a second diafiltration permeate and a second diafiltration retentate; and wherein the second diafiltration permeate is filtered through the nanofiltration membrane.

68. The process of claim 67, wherein at least the first diafiltration retentate, the second diafiltration retentate, and the nanofiltration permeate are combined to produce molasses.

69. The process of claim 45, further comprising evaporating the nanofiltration retentate to produce a concentrated syrup, and crystallizing white sugar from the concentrated syrup.

70. The process of claim 69, wherein a mother liquor remains after crystallization of white sugar from the concentrated syrup, and the mother liquor is recycled to one of the ultrafiltration membranes.

71. The process of claim 45, wherein the feed juice is at a temperature of about 140–200° F. during filtration through the first ultrafiltration membrane.

72. The process of claim 71, wherein the feed juice is at a temperature of about 160–185° F. during filtration through the first ultrafiltration membrane.

73. The process of claim 45, wherein the first ultrafiltration membrane has a molecular weight cutoff of at least about 2,000 daltons and a pore size no greater than about 0.2 microns.

74. The process of claim 73, wherein the first ultrafiltration membrane has a molecular weight cutoff of about 4,000–200,000 daltons.

75. The process of claim 45, wherein the first ultrafiltration permeate has a color of about 3,000–15,000 icu.

76. The process of claim 45, wherein the second ultrafiltration membrane has a molecular weight cutoff of about 500–5,000 daltons.

77. The process of claim 76, wherein the second ultrafiltration membrane has a molecular weight cutoff of about 1,000–4,000 daltons.

78. The process of claim 45, wherein the second ultrafiltration permeate has a color no greater than about 8,000 icu.

79. The process of claim 45, wherein the second ultrafiltration permeate has a color no greater than about 4,000 icu.

80. The process of claim 45, wherein the nanofiltration permeate comprises at least about 30% by weight on a dry solids basis of the ash present in the feed juice.

81. The process of claim 45, wherein the nanofiltration permeate comprises at least about 30% by weight on a dry solids basis of the invert sugars present in the feed juice.

82. The process of claim 45, wherein at least one aqueous stream selected from the group consisting of the feed juice, the first ultrafiltration permeate, the second ultrafiltration permeate, and the nanofiltration retentate is contacted with an agent selected from the group consisting of sulfur dioxide, sulfite salts, bisulfite salts, metabisulfite salts, dithionite salts, and mixtures thereof, in an amount sufficient to provide an equivalent concentration of sulfur dioxide in the stream of at least about 100 ppm.

83. The process of claim 45, where no lime and no carbon dioxide are contacted with any of the permeates.

* * * * *

UNITED STATES PATENT AND TRADEMARK OFFICE

CERTIFICATE OF CORRECTION

PATENT NO. : 6,406,548 B1 
DATED : June 18, 2002
INVENTOR(S) : Michael Donovan et al.

It is certified that error appears in the above-identified patent and that said Letters Patent is hereby corrected as shown below:

Column 16,
Line 14, delete “through a” and insert -- through the --.

Signed and Sealed this

Fifth Day of August, 2003

JAMES E. ROGAN
*Director of the United States Patent and Trademark Office*